US009400465B2

(12) United States Patent
Eiki et al.

(10) Patent No.: US 9,400,465 B2
(45) Date of Patent: Jul. 26, 2016

(54) FIXING DEVICE AND IMAGE FORMING APPARATUS

(71) Applicant: KYOCERA Document Solutions Inc., Osaka (JP)

(72) Inventors: Takashi Eiki, Osaka (JP); Yoshihiro Yamagishi, Osaka (JP); Takefumi Yotsutsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/933,246

(22) Filed: Nov. 5, 2015

(65) Prior Publication Data

US 2016/0132007 A1 May 12, 2016

(30) Foreign Application Priority Data

Nov. 10, 2014 (JP) ..... 2014-228160

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 2215/2035; G03G 15/2064; G03G 15/2042; G03G 15/2017; G03G 15/2007; H05B 3/03; H05B 3/26

See application file for complete search history.

(56) References Cited

U.S. PATENT DOCUMENTS

2008/0232871 A1* 9/2008 Jung ..... G03G 15/2039 399/329
2011/0182634 A1* 7/2011 Ishigaya ..... G03G 15/2064 399/328
2011/0206409 A1* 8/2011 Kondo ..... G03G 15/2017 399/92
2011/0222931 A1* 9/2011 Shinshi ..... G03G 15/2064 399/329
2013/0183071 A1 7/2013 Iwaya et al.
2014/0294464 A1* 10/2014 Maruyama ..... G03G 15/2053 399/329
2015/0063884 A1 3/2015 Iwaya et al.

FOREIGN PATENT DOCUMENTS

JP 2013-145288 A 7/2013

* cited by examiner

*Primary Examiner* — Francis Gray
(74) *Attorney, Agent, or Firm* — Studebaker & Brackett PC

(57) ABSTRACT

A fixing device fixing an image on a recording medium includes a fixing belt rotatable around a first rotation axis, a pressuring member, a heat source body and a cover member. The pressuring member forms a nip part pressuring and making the recording medium pass through with the fixing belt. The heat source body is arranged inside the fixing belt and heats the fixing belt by emitting radiant heat. The cover member is arranged between the fixing belt and the heat source body and covers the heat source body. The nip part has a passing area where the recording medium passes through and a non-passing area outside the passing area in an axial direction. The cover member covers a part of the heat source body corresponding to the non-passing area and includes through holes formed so as to adjust surface temperature of the heat source body.

12 Claims, 8 Drawing Sheets

FIXING DEVICE AND IMAGE FORMING APPARATUS

INCORPORATION BY REFERENCE

This application is based on and claims the benefit of priority from Japanese Patent application No. 2014-228160 filed on Nov. 10, 2014, the entire contents of which are incorporated herein by reference.

BACKGROUND

The present disclosure relates to a fixing device fixing a image onto a recording medium, such as a sheet, and an image forming apparatus, such as a copying machine, a printer, a facsimile or a multifunction peripheral, including the fixing device.

In recent years, in an art of an electrographic image forming apparatus, a belt type fixing device rotating an endless fixing belt made of a thin material having a metal layer and a resin layer together with a pressuring roller tends to diffuse. The belt type fixing device can be designed so as to shorten a warming up time by using the fixing belt with a low heat capacity as compared with a conventional heat roller type fixing device.

In the belt type fixing device, inside the fixing belt, a heat source body, e.g. a halogen heater, is provided, and then, the fixing belt is heated by radiant heat emitted from the heat source body. Moreover, a length in an axial direction of the fixing belt is set longer than a maximum width of a sheet passing through a nip part between the fixing belt and the pressuring roller and a length in an axial direction of the heat source body is also set by an equivalent length of this.

In a case where the image forming apparatus carries out a printing operation continuously for a long time, the fixing belt is heated by the heat source body for a long time. In this case, in a passing area as an area in the nip part where the sheet passes through, heat is absorbed by the sheet passing through the nip part. However, in a non-passing area outside the passing area in the axial direction in the nip part, the heat is not absorbed by the sheet. Because of this, the fixing belt may become an excessive temperature rise state at the non-passing area.

In order to prevent the fixing belt from becoming the excessive temperature rise state at the non-passing area, the belt type fixing device covering an end part of the heat source body positioned at the non-passing area by a cover is developed. However, this cover has the following problem. That is, because the cover is merely a nonporous metal plate, radiant heat emitted from the heat source body is reflected at the end part of the heat source body by an inside face of the cover. As a result, it is feared that surface temperature of the end part of the heat source body (e.g. a sealing part of the halogen heater or an end part of a valve) becomes excessive and exceeds a surface limit temperature of the end part of the heat source body.

In the belt type fixing device, in order to control the temperature of the fixing belt, a temperature sensor, for example, using a thermistor, is arranged at an outer circumference side of the fixing bet. A plurality of temperature sensors are provided and positioned, for example, at a center part and an end part in the axial direction of the fixing belt, respectively. Out of these temperature sensors, the temperature sensor positioned at the end part has the following problem. That is, if the fixing belt becomes the excessive temperature rise state at the non-passing area by the continuous printing operation for a long time, it is feared that the temperature of the end part of the fixing belt positioned at the non-passing area exceeds an upper limit of a temperature detectable range of the temperature sensor and the temperature of the end part of the fixing belt cannot be certainly detected.

SUMMARY

In accordance with an embodiment of the present disclosure, a fixing device fixing an image on a recording medium includes an endless fixing belt, a pressuring member, a heat source body and a cover member. The fixing belt is rotatably arranged around a first rotation axis. The pressuring member is rotatably arranged around a second rotation axis in parallel to the first rotation axis and configured so as to form a nip part pressuring and making the recording medium pass through with the fixing belt. The heat source body is arranged inside the fixing belt and configured so as to have a longitudinal shape extending in roughly parallel to the first rotation axis and to heat the fixing belt by emitting radiant heat. The cover member is arranged between the fixing belt and the heat source body and configured so as to cover the heat source body. The nip part has a passing area as an area where the recording medium passes through and a non-passing area as an area outside the passing area in an axial direction. The cover member covers a part of the heat source body corresponding to the non-passing area. The cover member includes a plurality of through holes formed so as to adjust surface temperature of the heat source body.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, an embodiment of the present disclosure will be described with reference to the drawings.

Figure 1:
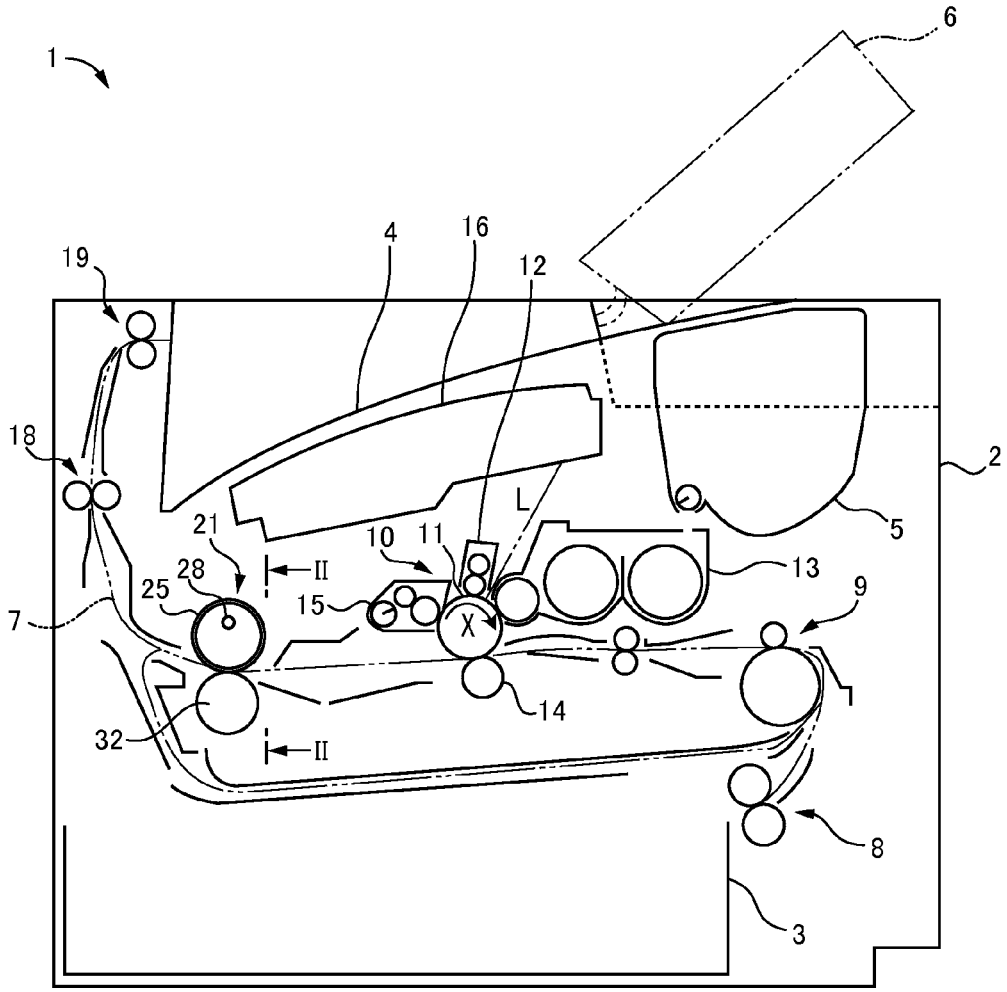
FIG. 1 is a sectional view showing an image forming apparatus according to an embodiment of the present disclosure.

FIG. 1 shows an image forming apparatus according to the embodiment of the present disclosure. In FIG. 1, the image forming apparatus 1 according to the embodiment of the present disclosure is an electrographic image forming apparatus, e.g. a printer. The image forming apparatus 1 includes a box-like housing 2. In a lower part of the housing 2, a sheet feeding cartridge 3 is installed. In the sheet feeding cartridge 3, sheets as recording mediums are stored. In an upper part of the housing 2, an ejected sheet tray 4 is formed. Moreover, in the upper part of the housing 2, an installation part used for installing a toner container 5 is provided and, in the housing 2, a lid part 6 opening/closing the installation part is provided.

Inside the housing 2, a conveying path 7 conveying the sheet stored in the sheet feeding cartridge 3 is arranged. At an upstream side in the conveying path 7, a sheet feeding roller 8 is positioned and, at a downstream side from the sheet feeding roller 8, a conveying roller 9 is positioned. At a downstream side from the conveying roller 9, an image forming part 10 is positioned. The image forming part 10 includes a photosensitive drum 11, a charger 12, a development device 13, a transfer roller 14 and a cleaning device 15. Above the image forming part 10, an exposure device 16 is provided. In the conveying path 7, at a downstream side from the image forming part 10, a fixing device 21 according to the embodiment of the present disclosure is provided. The fixing device 21 includes a fixing belt 25, a pressuring roller 32, a halogen heater 28 as a heat source body heating the fixing belt 25 and others as described later. At a downstream side from the fixing device 21, a conveying roller 18 is provided and, at a downstream side from the conveying roller 18 and near the ejected sheet tray 4, a sheet ejecting roller 19 is provided.

Moreover, although illustration is omitted in the figures, the image forming apparatus 1 includes a storing part, a controlling part and a power supply circuit. The storing part has a semiconductor storage element, for example, to temporarily store image data received from an external device, such as a personal computer. The controlling part has a central processing unit to control the exposure device 16, the image forming part 10, the fixing device 21 and others. The power supply circuit controls supply of electric power for operating the image forming apparatus 1.

The printing operation of the image forming apparatus 1 with such a configuration will be described as follows. When data of an image to be printed onto the sheet is inputted into the image forming apparatus 1, a surface of the photosensitive drum 11 is electrically charged by the charger 12 and a laser light L corresponding to the image data is emitted from the exposure device 16 to the photosensitive drum 11 to form an electrostatic latent image on the surface of the photosensitive drum 11. Further, a toner image corresponding to the electrostatic latent image is formed onto the surface of the photosensitive drum 11 by the development device 13. On the other hand, the sheet stored in the sheet feeding cartridge 3 is conveyed by the sheet feeding roller 8 and the conveying roller 9 to pass between the photosensitive drum 11 and the transferring roller 14. At this time, the toner image formed on the surface of the photosensitive drum 11 is transferred onto a surface of the sheet. After the toner image is transferred, a toner remained on the surface of the photosensitive drum 11 is collected by the cleaning device 15. Subsequently, the sheet with the transferred toner image is passed between the fixing belt 25 and the pressuring roller 32 of the fixing device 21. At this time, by heat of the fixing belt 25 heated by the halogen heater 28, the toner image is molten and fixed on the sheet. The sheet with the fixed toner image is conveyed by the conveying roller 18 and the sheet ejecting roller 19 and ejected onto the ejected sheet tray 4.

Figure 2:
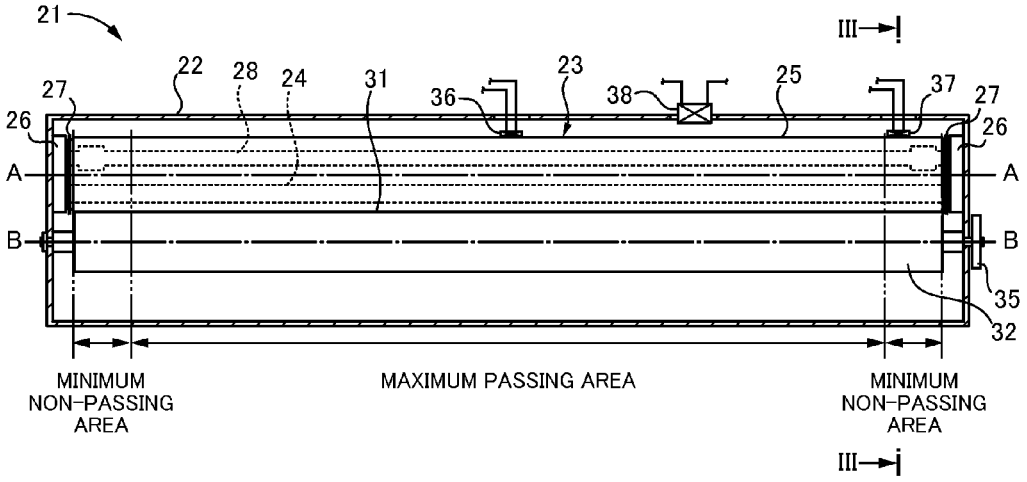
FIG. 2 is a sectional view showing a fixing device, as viewed from a direction indicated by II-II arrows in FIG. 1, according to the embodiment of the present disclosure.
Figure 3:
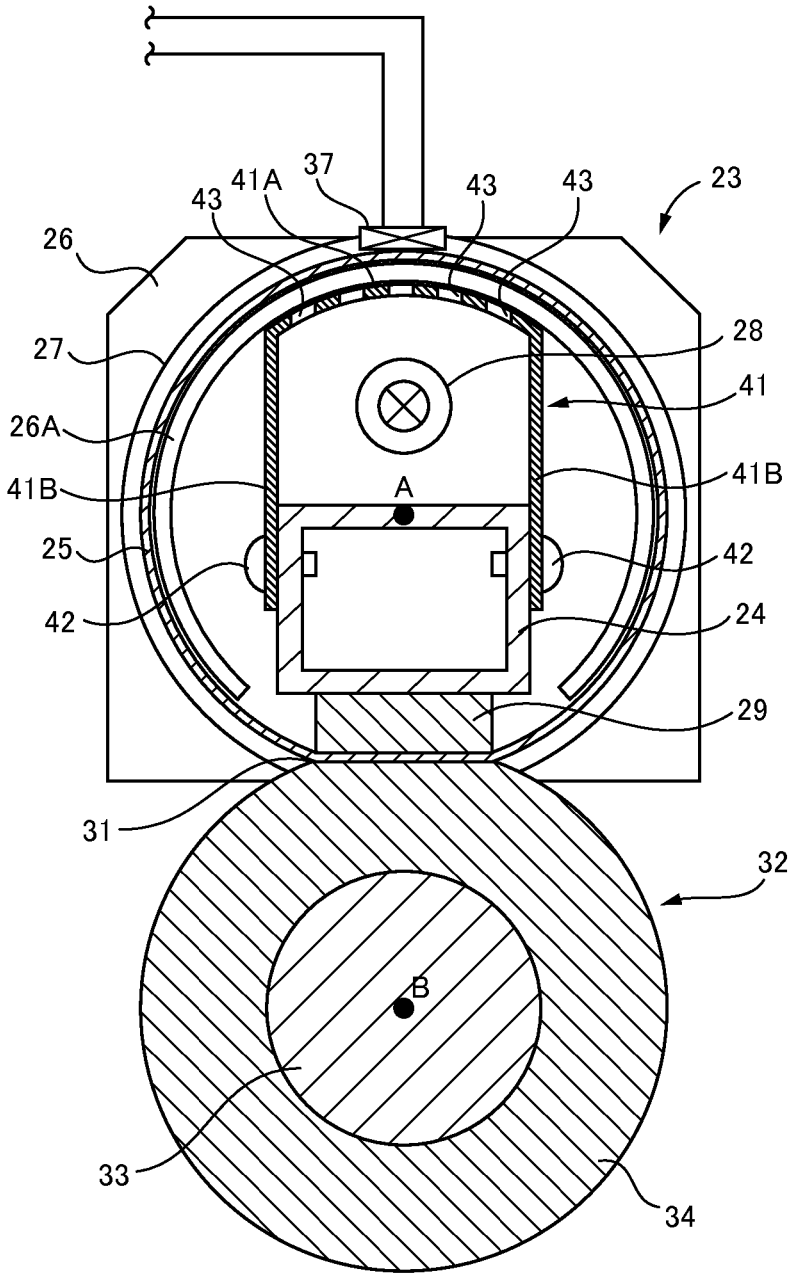
FIG. 3 is a sectional view showing a fixing belt unit and a pressuring roller of the fixing device, as viewed from a direction indicated by III-III arrows in FIG. 2, according to the embodiment of the present disclosure.
Figure 4:
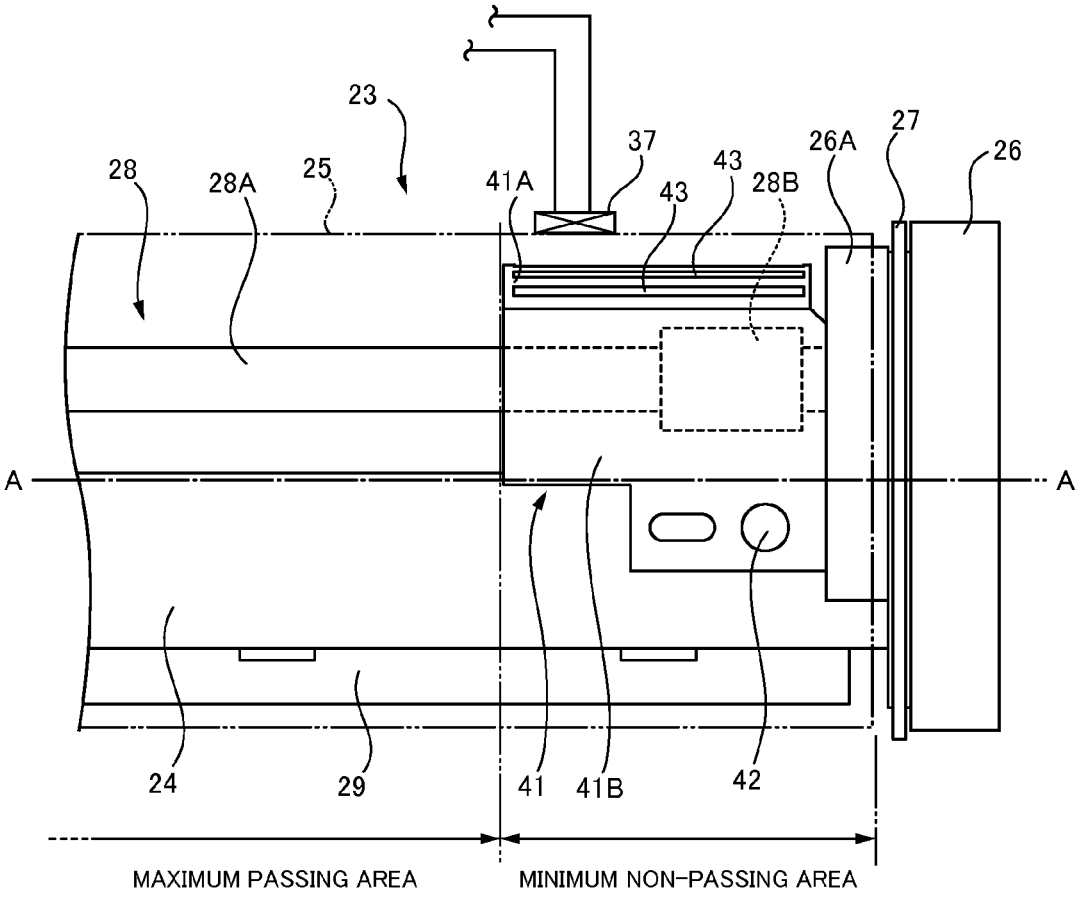
FIG. 4 is an enlarged view showing an end part of the fixing belt unit according to the embodiment of the present disclosure.

FIG. 2 shows the fixing device 21 as viewed from a direction indicated by II-II arrows in FIG. 1. FIG. 3 shows a section of a fixing belt unit 23, the pressuring roller 32 and others as viewed from a direction indicated by III-III arrows in FIG. 2. FIG. 4 shows an end part of the fixing belt unit 23 in FIG. 2. In FIG. 2, the fixing device 21 includes a frame part 22 constituting its outer frame and, for example, being made of a metal plate. Inside the frame part 22, the fixing belt unit 23 and the pressuring roller 32 are attached. The fixing belt unit includes a stay 24, a fixing belt 25, a pair of attachment members 26, a pair of regulation rings 27, a halogen heater 28, a nip forming member 29, a pair of cover members 41 and others. Incidentally, the nip forming member 29 and the cover members 41 are illustrated in FIGS. 3 and 4, but omitted in FIG. 2.

In the fixing belt unit 23, as shown in FIG. 2, a rotation axis A-A (a first rotation axis) extending in a direction orthogonal to a conveying direction of the sheet is determined. The stay 24 is a bar-like or cylinder-like member extending in a direction (an axial direction) in parallel to the rotation axis A-A and constitutes a framework of the fixing belt unit 23.

The fixing belt 25 is arranged around the stay 24. The fixing belt 25 is an endless belt and is formed in a cylindrical shape elongated in the axial direction. The fixing belt 25 is thin and has flexibility. The fixing belt 25 is composed by coating a base material layer with a release layer. The base material layer is made of, for example, metal, such as stainless steel, resin, such as polyimide, or others. The release layer is made of, for example, resin, such as perfluoro alkoxy fluororesin (PFA). The fixing belt 25 can be rotated around the rotation axis A-A. Incidentally, illustration of the structure of the base material layer and the release layer constituting the fixing belt 25 is omitted in the figures.

Each attachment member 26 is a member for fastening the stay 24 immovably inside the frame part 22, supporting the fixing belt 25 rotatably with respect to the frame part 22 and fastening the halogen heater 28, the nip forming member 29 and others immovably with respect to the frame part 22. The attachment members 26 are respectively arranged at both end sides of the fixing belt 25. For example, in each attachment member 26, a stay attaching hole (not shown) used for fastening each of end parts of the stay 24 is formed. The stay 24 is fastened to each attachment member 26 by engaging an engaging part formed in each end part with the stay attaching hole of each attachment member 26.

In each attachment member 26, as shown in FIG. 4, an arc-shaped projection ridge part 26A projecting toward the center in the axial direction from a face facing to the center in the axial direction is formed. Each end part of the fixing belt 25 is attached at an outer circumference side of the projection ridge part 26A. As shown in FIG. 2, both end parts of the fixing belt 25 is sandwiched by the pair of attachment members 26, and thereby, movement in the axial direction of the fixing belt 25 is regulated. On the other hand, each end part of the fixing belt 25 can be moved on an outer circumference face of the projection ridge part 26A of each attachment member 26. According to this, the fixing belt 25 can be rotated around the rotation axis A-A.

The regulation rings 27 are respectively arranged, as shown in FIG. 2, at both end sides of the fixing belt 25. Each regulation ring 27 is an annular member and is positioned between each end part of the fixing belt 25 and each attachment member 26. As shown in FIG. 4, each regulation ring 27 is arranged rotatably with respect to the projection ridge part 26A of each attachment member 26. The regulation rings 27 have functions regulating meandering of the fixing belt 25 in rotation and stabilizing the rotation of the fixing belt 25.

The halogen heater 28 is a heat source body emitting radiant heat and heating the fixing belt 25 and is arranged, as shown in FIG. 2, inside the fixing belt 25. The halogen heater 28 has a longitudinal shape extending in roughly parallel to the rotation axis A-A and has a roughly equivalent length of a length in the axial direction of the fixing belt 25. The halogen heater 28 includes, as shown in FIG. 4, a valve part 28A emitting the radiant heat and sealing parts 28B respectively arranged at both end side of the valve part 28A. Both end parts of the halogen heater 28 are respectively fastened by the attachment members 26.

Figure 5:
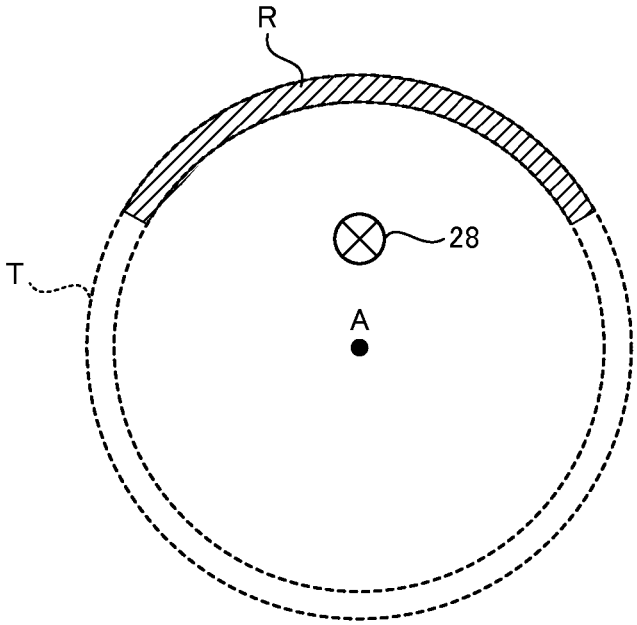
FIG. 5 is a schematic diagram showing a heated range of a halogen heater according to the embodiment of the present disclosure.

The halogen heater 28 is arranged, as shown in FIG. 3, between the stay 24 and the fixing belt 25 inside the fixing belt 25 and positioned above the rotation axis A-A. As a result, the halogen heater 28 is closest to an upper area of a rotation track of the fixing belt 25 around the rotation axis A-A. Therefore, the halogen heater 28 heats mainly a part of the fixing belt 25 passing through this upper area. Incidentally, during the printing operation, since the fixing belt 25 is continuously rotated around the rotation axis A-A, the fixing belt 25 over the entire circumference is heated by the halogen heater 28. Here, FIG. 5 shows the upper area (a heated area) R heated by the halogen heater 28 in the rotation track T of the fixing belt 25. That is, a part indicated by hatching in FIG. 5 is the heated area R.

The nip forming member 29 is arranged, as shown in FIG. 3, inside the fixing belt 25 and positioned at a position facing to the pressuring roller 32 below the stay 24. The nip forming member 29 is a longitudinal member extending in the axial direction and has a roughly equivalent length of a length in the axial direction of the fixing belt 25. The nip forming member 29 is made of heat resistant resin, such as liquid crystal polymer (LCP), and fastened by the stay 24 or each attachment member 26. The nip forming member 29 and the pressuring roller 32 push each other across the fixing belt 25 to form a nip part 31 between the fixing belt 25 and the pressuring roller 32.

The fixing belt unit 23 includes a reflection member and others in addition to the above-described components and members and the reflection member reflects the radiant heat emitted from the halogen heater 28 toward the heated area R, but illustration and description of the reflection member and others are omitted. Moreover, the fixing belt unit 23 includes, as shown in FIG. 4, a pair of cover members 41 covering both end sides of the halogen heater 28, but the pair of cover members 41 are described later.

On the other hand, in the fixing device 21, as shown in FIG. 2, the pressuring roller 32 is adjacent to the fixing belt 25 at a lower side of the fixing belt 25. The pressuring roller 32 is a columnar roller elongated in the axial direction and includes, as shown in FIG. 3, a core material 33, an elastic layer 34 arranged around the core material 33 and a release layer (not shown) coating an outer circumference face of the elastic layer 34. Both end parts of the pressuring roller 32 are rotatably attached by the frame part 22. The pressuring roller 32 is connected, as shown in FIG. 2, to a power transmission mechanism 35 and connected to a motor (not shown) via the power transmission mechanism 35. The pressuring roller 32 is rotated around a rotation axis B-B (a second rotation axis) in parallel to the rotation axis A-A by driving the motor. An outer circumference face of the pressuring roller 32 is pressed to the nip forming member 29 via the fixing belt 25, and thereby, the nip part 31 pressuring and making the sheet pass through is formed between the pressuring roller 32 and the fixing belt 25. Since the outer circumference face of the pressuring roller 32 is pressed to the nip forming member 29 via the fixing belt 25, when the pressuring roller 32 is rotated by driving the motor, the fixing belt 25 is rotated.

The fixing device 21 includes, as shown in FIG. 2, for example, two temperature sensors 36 and 37. One temperature sensor 36 is positioned at a center part in the axial direction of the fixing belt 25 and another temperature sensor 37 is positioned at an end side in the axial direction of the fixing belt 25. Each of the temperature sensors 36 and 37 includes, for example, thermistor. In each of the temperature sensors 36 and 37, a distal end side where the thermistor is positioned comes into contact with an outer circumference of fixing belt 25 and a proximal end side is fastened by the frame part 22. These temperature sensors 36 and 37 detect temperatures at the center part and the end side in the axial direction of the fixing belt 25 to output detection signals indicating these detection results to the controlling part. The controlling part controls the halogen heater 28 on the basis of the detection signals outputted from the temperature sensors 36 and 37, for example, so as to maintain the temperature of the fixing belt 25 at predetermined temperature. Incidentally, the temperature sensor 37 is a concrete example of a temperature detecting part.

The frame part 22 of the fixing device 21 includes a thermostat 38. The thermostat 38 is positioned at a position away from the outer circumference face of the fixing belt 25 by a predetermined gap (a position being not in contact with the outer circumference face and being considerably close to the outer circumference face) and fastened by the frame part 22 so as to face to the outer circumference face of the fixing belt 25. The above-described temperature sensors 36 and 37 are temperature detecting parts used for controlling the temperature of the fixing belt 25 by controlling the halogen heater 28 in normal operation. By contrast, the thermostat 38 is a temperature detecting parts used for forcedly turning off the halogen heater 28 and preventing an accident and damage of the fixing device 21 beforehand when the temperature of the fixing belt 25 is likely to become abnormally high temperature, for example, due to thermal runaway of the halogen heater 28 or others. An electric configuration of the thermostat 38 will be described as follows. The thermostat 38 is connected to the middle of an electric route of supplying the electric power for turning on the halogen heater 28. The thermostat 38 connects the electric route while the temperature of the fixing belt 25 is a predetermined threshold or less and the threshold is determined so that detect abnormally temperature rise is detected. On the other hand, the thermostat 38 breaks the electric route when the temperature of the fixing belt 25 exceeds the predetermined threshold.

Figure 6:
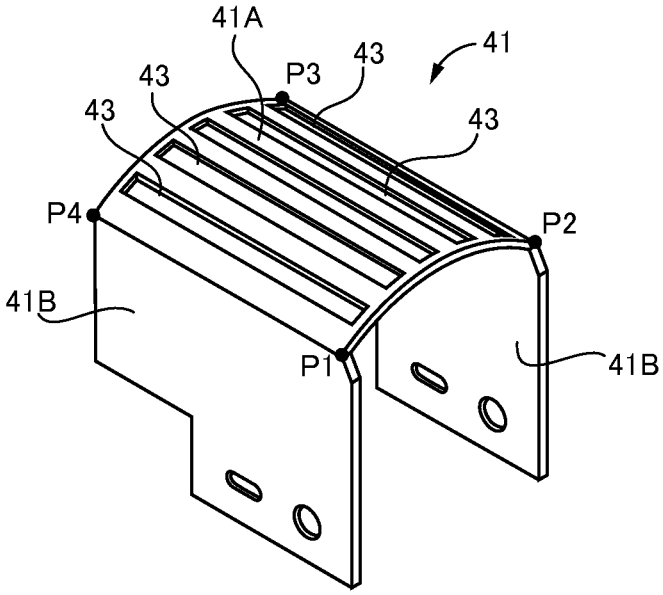
FIG. 6 is a perspective view showing a cover member of the fixing device according to the embodiment of the present disclosure.

FIG. 6 shows one of the cover members 41. As shown in FIG. 4, each cover member 41 is a member covering an end side of the halogen heater 28. FIG. 4 shows one cover member 41 covering one end side of the halogen heater 28, but the fixing belt unit 23 includes the pair of the cover members 41 and the pair of the cover members 41 cover both end sides of the halogen heater 28. Because the pair of the cover members 41 are configured symmetrically in the axial direction and have similar structure, in the following, one cover member 41 shown in FIG. 4 will be described.

The cover member 41 is arranged, as shown in FIG. 4, inside the fixing belt 25 to cover an outer circumference side of the end part of the halogen heater 28. As a result, between the end part of the fixing belt 25 and the end part of the halogen heater 28, the cover member 41 is interposed.

The cover member 41 covers a part in the halogen heater 28 corresponding to a non-passing area (e.g. a minimum non-passing area). That is, the end part of the halogen heater 28 covered by the cover member 41 is the part corresponding to the non-passing area (the minimum non-passing area). In the nip part 31 formed between the fixing belt 25 and the pressuring roller 32, an area where the sheet passes through is called as a "passing area" and an area adjacent to the passing area outside the passing area in the axial direction in the nip part 31 is called as a "non-passing area". Incidentally, an area where the sheet with a maximum width dimension (a length dimension corresponding to a length in the axial direction of the fixing belt 25) passes through is called as a "maximum passing area" and an area adjacent to the maximum passing area outside the maximum passing area in the axial direction in the nip part 31 is called as a "minimum non-passing area". The cover member 41 is positioned at an area corresponding to the non-passing area (the minimum non-passing area) to cover the part in the halogen heater 28 corresponding to the non-passing area (the minimum non-passing area). In other words, the cover member 41 does not cover a part in the halogen heater 28 corresponding to the passing area (the maximum passing area).

The cover member 41 is formed, as shown in FIG. 6, by bending a metal plate, e.g. made of stainless steel, in an inversed U-shape and has an upper plate part 41A at an upper side and lateral plate parts 41B at its both sides. As shown in FIG. 3, the upper plate part 41A covers the part in the halogen heater 28 corresponding to the non-passing area (the minimum non-passing area) from the upper side and the lateral plate parts 41B cover the part in the halogen heater 28 corresponding to the non-passing area (the minimum non-passing area) from lateral sides. The cover member 41 is fastened, as shown in FIG. 3, to the stay 24, for example, by screws 42.

As shown in FIG. 4, in the cover member 41, an end part at a side near the center in the axial direction of the fixing belt 25 is positioned at a position roughly coinciding with a boundary line between the maximum passing area and the minimum non-passing area. In the cover member 41, an end part at a side away from the center in the axial direction of the fixing belt 25 is positioned at a position roughly coinciding with a proximal end part in the axial direction of the halogen heater 28. That is, the cover member 41 covers the halogen heater 28 from the position roughly coinciding with the boundary line between the maximum passing area and the minimum non-passing area to the proximal end part of the halogen heater 28.

In the upper plate part 41A of the cover member 41, a plurality of through holes 43 used for adjusting the surface temperature of the halogen heater 28 are formed. In the cover member 41 as shown in FIG. 6, each through hole 43 has a slit-like shape extending in the axial direction and five through holes 43 are formed in the upper plate part 41A.

The shape, the size and the number of the through holes 43 are determined so as to maintain the surface temperature of the halogen heater 28 by a surface limit temperature of the halogen heater 28 or less in a fixing operation. An area surrounded by vertexes P1, P2, P3 and P4 in the cover member 41 shown in FIG. 6 is a range of the upper plate part 41A. In a surface of the upper plate part 41A having such a range, a part where the through holes 43 are not formed is called as a covering face and a rate of the covering face with respect to an area of the entire surface of the upper plate part 41A is called as a covering rate of the cover member 41. The covering rate of the cover member 41 is determined so as to maintain the surface temperature of the halogen heater 28 by the surface limit temperature of the halogen heater 28 or less in the fixing operation. Incidentally, the surface limit temperature of the halogen heater 28 is different for each kind and each product of the halogen heater. As one example, the surface limit temperature of the valve part 28A is determined by 800 degrees and the surface limit temperature of the sealing part 28B is determined by 350 degrees.

The surface temperature of the halogen heater 28 is different in accordance with an operational condition and an operational environment of the halogen heater 28, e.g. the number of prints per unit time in the image forming apparatus 1 or a consumed electric power of the image forming apparatus 1. Thereupon, the covering rate of the cover member 41 is determined with taking the operational condition and the operational environment of the halogen heater 28 into account.

Figure 7:
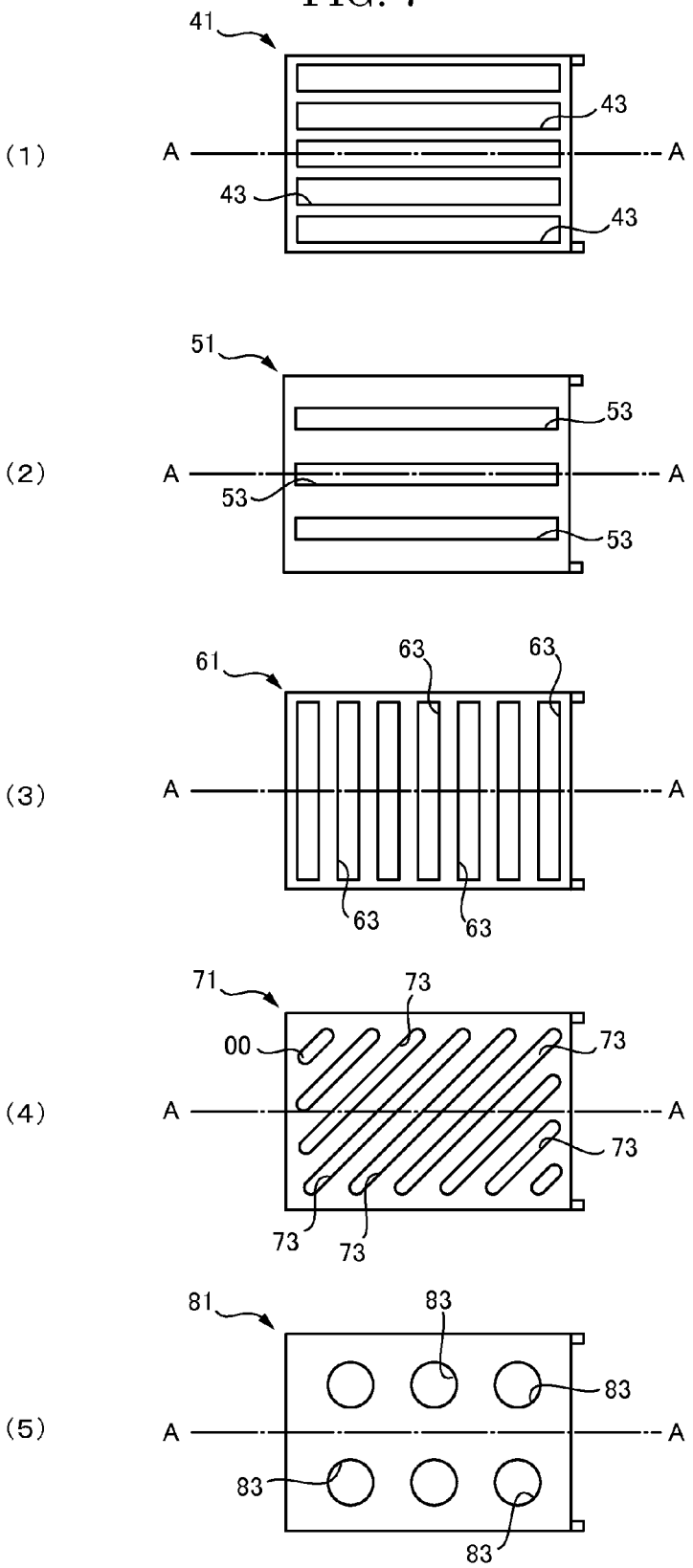
FIG. 7 is plan views showing cover members with through holes formed respectively by various patterns in the fixing device according to the embodiment of the present disclosure.

FIG. 7 shows various patterns of the through holes formed in the upper plate parts of the cover members of various modes (1)-(5). The cover member 41 of a first mode (1) shown in FIG. 7 is the same as that shown in FIG. 6, and then, the shape of each through hole 43 is a slit-like shape extending in the axial direction, the size of each through hole 43 is relatively large and the number of the through holes 43 is five. In a cover member 51 of a second mode (2) shown in FIG. 7, the shape and the size of each of through holes 53 are the same as those of the first mode (1), but the number of the through holes 53 is less than that of first mode (1). The cover member 51 of the second mode (2) has a higher covering rate than the cover member 41 of the first mode (1). In a cover member 61 of a third mode (3) shown in FIG. 7, the shape of each of through holes 63 is a slit-like shape extending in a direction orthogonal to the axial direction, the size of each through hole 63 is relatively small and the number of the through holes 63 is relatively large. In a cover member 71 of a fourth mode (4) shown in FIG. 7, the shape of each of through holes 73 is a slit-like shape extending in a diagonal direction, the size of each through hole 73 is relatively small and the number of the through holes 73 is relatively large. The cover member 61 of the third mode (3) and the cover member 71 of the fourth mode (4) have respective covering rates lower than the cover member 51 of the second mode (2). In a cover member 81 of a fifth mode (5) shown in FIG. 7, the shape of each of through holes 83 is a circular shape, the size of each through hole 83 is relatively small and the number of the through holes 83 is not large. The cover member 81 of the fifth mode (5) has a relatively high covering rate.

As mentioned above, at the end side in the axial direction of the fixing belt 25, the temperature sensor 37 is positioned. Strictly, the temperature sensor 37 is positioned, as shown in FIG. 4, at the part corresponding to the non-passing area (the minimum non-passing area). The cover member 41 covers a part in the halogen heater 28 facing to the end side's temperature sensor 37 in a radial direction. That is, between the end side's temperature sensor 37 and the halogen heater 28, the upper plate part 41A of the cover member 41 is interposed. In the embodiment, in a part in the upper plate part 41A of the cover member 41 facing to the temperature sensor 37 in the radial direction, the through holes 43 are formed. The shape, the size and the number of the through holes 43, i.e. the covering rate of the cover member 41, are determined so as not only to maintain the surface temperature of the halogen heater 28 by the surface limit temperature of the halogen heater 28 or less in the fixing operation, but also to not make actual detection temperature of the temperature sensor 37 exceed an upper limit of a temperature detectable range of the temperature sensor 37.

As described above, in accordance with the fixing device 21 of the embodiment, since, inside the fixing belt 25, the cover member 41 covers the part in the halogen heater 28 corresponding to the non-passing area (the minimum non-passing area), it is possible to prevent the end part of the fixing belt 25, i.e. the part corresponding to the non-passing area (the minimum non-passing area) from becoming an excessive temperature rise state. Moreover, by forming the through holes 43 in the cover member 41, it is possible to prevent the part in the fixing belt 25 corresponding to the non-passing area from becoming the excessive temperature rise state and to prevent the surface temperature in the halogen heater 28 corresponding to the non-passing area from exceeding its limit temperature. That is, in a case where the image forming apparatus 1 carries out the printing operation continuously for a long time, the fixing belt 25 is heated by the halogen heater 28 for a long time. In this case, in the passing area (e.g. the maximum passing area), heat is absorbed by the sheet passing through the nip part 31. However, in the non-passing area (the minimum non-passing area), the heat is not absorbed by the sheet. Because of this, the temperature of the fixing belt 25 easily rises at the non-passing area as compared with the passing area. Incidentally, when the sheet with a narrower width than the maximum width passes through the nip part 31, the non-passing area has an area close to the center from the minimum non-passing area in the axial direction to become a wider area than the minimum non-passing area, and then, the temperature of the fixing belt 25 easily rises at the wide non-passing area. If continuous printing of the sheet with the maximum width (e.g. the sheet of A4 size) for a long time is carried out at high frequency, because temperature rise of the fixing belt 25 at the minimum non-passing area often causes problems, prevention measures of excessive temperature rise of the fixing belt 25 at the minimum non-passing area is important. However, the image forming apparatus 1 according to the embodiment can provide such prevention measures.

Moreover, the end part in the cover member 41 at the side near the center in the axial direction is positioned at the position roughly coinciding with the boundary line between the passing area (the maximum passing area) and the non-passing area (the minimum non-passing area) and the cover member 41 covers the halogen heater 28 from the position roughly coinciding with the boundary line between the passing area (the maximum passing area) and the non-passing area (the minimum non-passing area) to the proximal end part of the halogen heater 28. Accordingly, it is possible to improve efficiency preventing the excessive temperature rise of the part in the fixing belt 25 corresponding to the non-passing area (the minimum non-passing area).

Further, by forming the through holes 43 in the cover member and suitably determining the shape, the size and the number of the through holes 43 to appropriately adjust the covering rate of the cover member 41, it is possible to prevent the part of the fixing belt 25 corresponding to the non-passing area (the minimum non-passing area) from becoming an excessive temperature rise state and to prevent the surface temperature of the part of the halogen heater 28 corresponding to the non-passing area (the minimum non-passing area) from coming close the limit temperature or exceeding the limit temperature.

Figure 8:
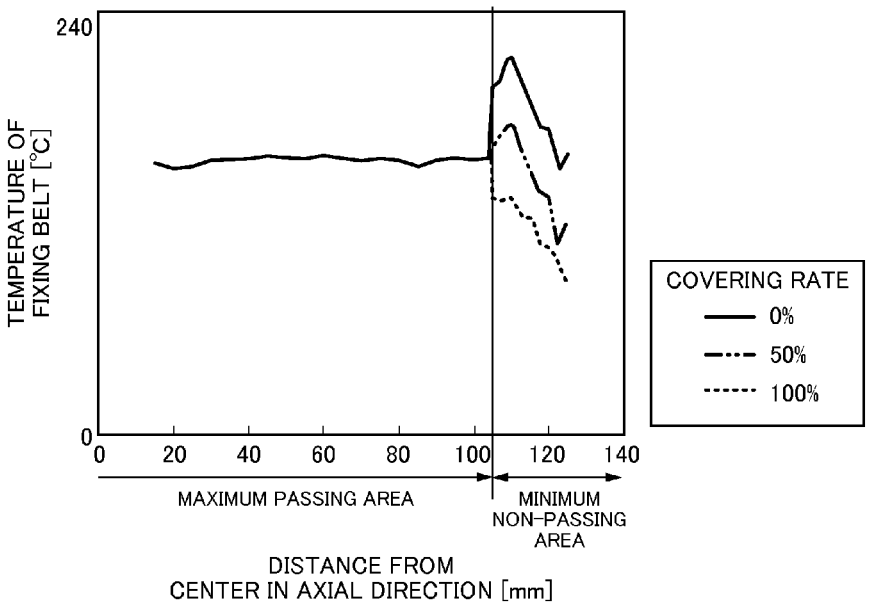
FIG. 8 is a graph plotting a position in an axial direction of the fixing belt and temperature of the fixing belt.

FIG. 8 shows a relationship of a position in the axial direction of the fixing belt 25 (a horizontal axis) and the temperature of the fixing belt 25 in the continuous printing for a long time (a vertical axis). In FIG. 8, a characteristic line of a solid line indicates the relationship of the position and the temperature of the fixing belt 25 in a case where the covering rate of the cover member is 0%. The covering rate of 0% means that the cover member is not provided. As seen from the characteristic line of the solid line, if the cover member is not provided, the temperature of the fixing belt 25 at the non-passing area (the minimum non-passing area) greatly rises as compared with the temperature at the passing area (the maximum passing area). A characteristic line of a two-dot chain line indicates the relationship of the position and the temperature of the fixing belt 25 in a case where the covering rate of the cover member is 50%. The covering rate of 50% is determined according to the shape, the size and the number of the through holes of the cover member. As seen from comparison between the characteristic line of the solid line and the characteristic line of the two-dot chain line, by providing the cover member with the covering rate of 50%, the temperature rise of the fixing belt 25 at the non-passing area (the minimum non-passing area) can be restrained more than the case where the cover member is not provided. A characteristic line of a dotted line indicates the relationship of the position and the temperature of the fixing belt 25 in a case where the covering rate of the cover member is 100%. The covering rate of 100% means that a nonporous cover member without any through hole is provided. As seen from comparison between the characteristic line of the dotted line and the characteristic line of the two-dot chain line, by providing the nonporous cover member, the temperature rise of the fixing belt 25 at the non-passing area (the minimum non-passing area) can be restrained further more than the case where the cover member with the covering rate of 50% is provided. Thus, in accordance with FIG. 8, it is understandable that as the covering rate of the cover member is higher, restraining efficiency of the temperature rise of the fixing belt 25 at the non-passing area (the minimum non-passing area) can be improved further.

Figure 9:
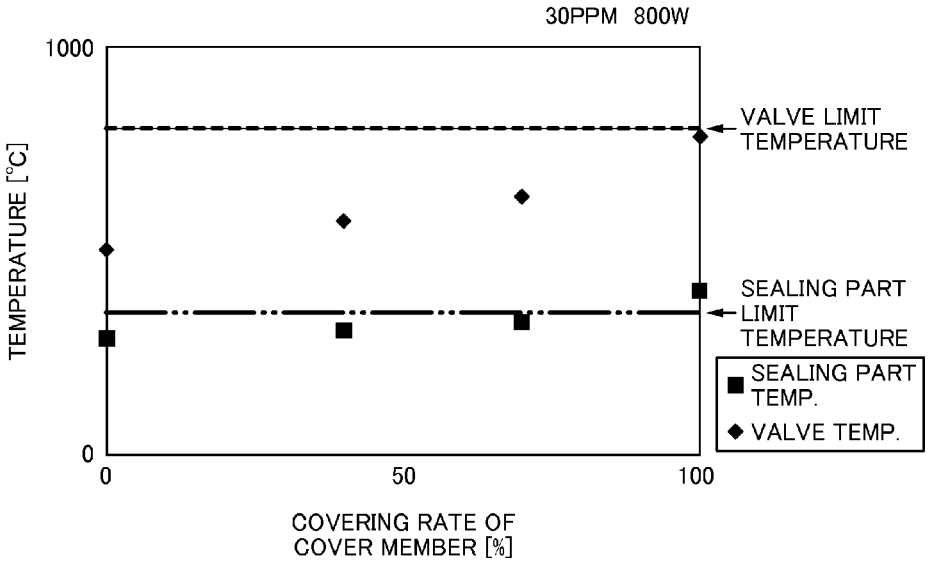
FIG. 9 is a graph plotting a covering rate of the cover member and surface temperature of the halogen heater.

On the other hand, FIG. 9 shows a relationship between the covering rate of the cover member (a horizontal axis) and the surface temperature of the valve part 28A of the halogen heater 28 (a vertical axis) and a relationship between the covering rate of the cover member (a horizontal axis) and the surface temperature of the sealing part 28B of the halogen heater 28 (a vertical axis), in a case where rotation speed of the fixing belt is 30 PPM (the number of prints per one minute) and electric power consumption is 800 W. In FIG. 9, a broken line indicates a limit temperature of the valve part 28A of the halogen heater 28 and a two-dot chain line indicates a limit temperature of the sealing part 28B of the halogen heater 28. As seen from FIG. 9, in the case where the covering rate of the cover member is 100% (the case where the nonporous cover member is provided), the surface temperature of the valve part 28A considerably comes close to its limit temperature and the surface temperature of the sealing part 28B exceeds the its limit temperature. Thus, in FIG. 9, it is understandable that if the cover member with the high covering rate being close to 100% is provided, the surface temperatures of the valve part 28A and the sealing part 28B of the halogen heater 28 considerably may come close to the limit temperature or may exceed the limit temperature.

Taking the relationships shown in FIGS. 8 and 9 into consideration, it is deemed that the covering rate of the cover member 41 is preferably determined by high percentages in order to prevent the excessive temperature rise of the fixing belt, but is preferably determined by less than 100%, e.g. by 70% or less, in order to maintain the surface temperature of the halogen heater 28 by the limit temperature or less. Therefore, the shape, the size and the number of the through holes formed in the cover member 41 is adjusted and determined so that the covering rate of the cover member 41 becomes within a range from 30% or more to 70% or less. Accordingly, it is possible to simultaneously achieve preventing of the excessive temperature rise of the fixing belt 25 at the non-passing area (the minimum non-passing area) and maintaining of the surface temperature of the part of the halogen heater 28 corresponding to the non-passing area (the minimum non-passing area) by the limit temperature or less. Thereby, it is possible to restrain degradation and consumption of the fixing belt 25 and prevent a malfunction of the halogen heater 28.

In accordance with the fixing device 21 according to the embodiment, by covering the part of the halogen heater 28 facing to the temperature sensor 37 in the radial direction by the cover member 41, it is possible to prevent heat quantity conducted from the halogen heater 28 to the temperature sensor 37 from becoming excessive at the area corresponding to the non-passing area (the minimum non-passing area) in the continuous printing for a long time. Thereby, it is possible to temperature around the temperature sensor 37 from exceeding the upper limit of the temperature detectable range of the temperature sensor 37. Therefore, even when the continuous printing for a long time is carried out, the temperature sensor 37 can certainly detect the temperature of the end part of the fixing belt 25 and it is possible to surely control the halogen heater 28 in high precision.

Figure 10:
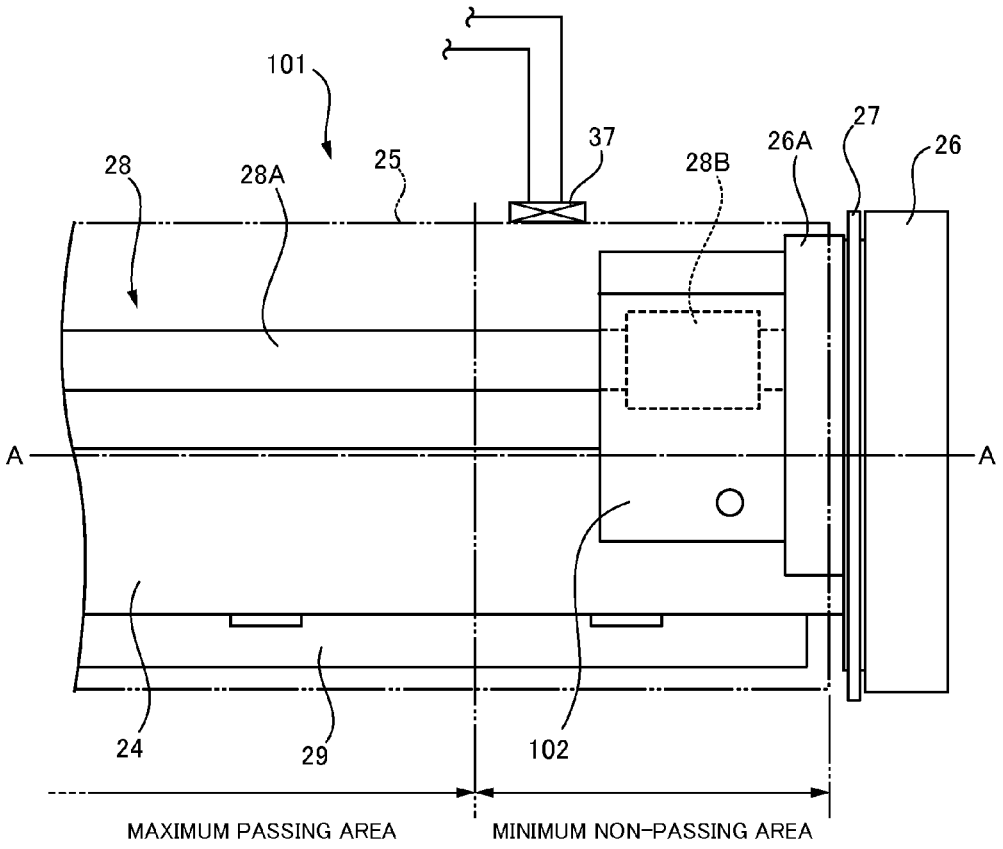
FIG. 10 is an enlarged view showing a fixing belt unit according to a comparative example.

FIG. 10 shows a comparative example of a fixing belt unit. A fixing belt unit 101 shown in FIG. 10 is configured so that the part in the halogen heater 28 facing to the temperature sensor 37 in the radial direction is not covered by a cover member 102. In such a configuration, it is feared that the temperature around the temperature sensor 37 exceeds the upper limit of the temperature detectable range of the temperature sensor 37 in the continuous printing for a long time. By contrast, in the fixing belt unit 23 as shown in FIG. 4 according to the embodiment of the present disclosure, since the cover member 41 covers the part in the halogen heater 28 facing to the temperature sensor 37 in the radial direction, it is possible to maintain the temperature around the temperature sensor 37 within the temperature detectable range of the temperature sensor 37 in the continuous printing for a long time.

Incidentally, although the above-described embodiment illustrates the case where the part corresponding in the halogen heater 28 corresponding to the non-passing area (the minimum non-passing area) is covered by the cover member 41, the present disclosure is not restricted by this case. For example, in the image forming apparatus, if a width of the sheet printed at high frequency is narrower than the maximum width of the sheet treated by the image forming apparatus, because the passing area corresponds to the width of the sheet printed at high frequency, it is feared that the non-passing area (an area wider than the minimum non-passing area) positioned outside the passing area in the axial direction becomes the excessive temperature rise. In such a case, the part in the halogen heater 28 corresponding to the non-passing area may be covered by the cover member.

Although the above-described embodiment illustrates a case where the end part in the cover member 41 at the side near the center in the axial direction of the fixing belt 25 is positioned at the position roughly coinciding with the boundary line between the passing area (the maximum passing area) and the non-passing area (the minimum non-passing area), the present disclosure is not restricted by this case. The position of the end part of the cover member 41 may be suitably adjusted according to an area actually becoming the excessive temperature rise in the fixing belt in the continuous printing for a long time. In FIG. 8, it is understandable that the temperature of the fixing belt steeply rises at the boundary between the maximum passing area and the minimum non-passing area. In such a case, by positioning the end part in the cover member 41 at the side near the center in the axial direction of the fixing belt 25 at the position roughly coinciding with the boundary line between the maximum passing area and the minimum non-passing area, it is possible to efficiently prevent the excessive temperature rise of the end part of the fixing belt 25.

Although, in the above-described embodiment, some patterns of the through holes 43 formed in the cover member 41 are described with reference to FIG. 7, the pattern of the through holes 43 is not restricted by these. For example, in a case of providing a recessed notch in an end part of the upper plate part 41A to form a space penetrating in the radial direction, the notch may be applied as one pattern of the through hole.

Although the above-described embodiment illustrates the halogen heater 28 as the heat source body, the heat source body is not restricted by this. The heat source body may be another heat source body, e.g. a ceramic heater or the like.

Although the above-described embodiment illustrates the printer as the image forming apparatus, the present disclosure is not restricted by this. The disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device fixing an image on a recording medium comprising:

an endless fixing belt rotatably arranged around a first rotation axis;

a pressuring member rotatably arranged around a second rotation axis in parallel to the first rotation axis and configured so as to form a nip part pressuring and making the recording medium pass through with the fixing belt;

a heat source body arranged inside the fixing belt and configured so as to have a longitudinal shape extending in roughly parallel to the first rotation axis and to heat the fixing belt by emitting radiant heat; and a cover member arranged between the fixing belt and the heat source body and configured so as to cover the heat source body, wherein the nip part has a passing area as an area where the recording medium passes through and a non-passing area as an area outside the passing area in an axial direction, the cover member covers a part of the heat source body corresponding to the non-passing area, the cover member includes a plurality of through holes formed so as to adjust surface temperature of the heat source body, the cover member is further composed of an upper plate part at an upper side and lateral plate parts at its both sides and the plurality of through holes are formed in the upper plate part.

2. The fixing device according to claim 1, wherein the cover member is configured so that the size and the number of the through holes are determined so as to maintain the surface temperature of the heat source body by a surface limit temperature of the heat source body or less in a fixing operation.

3. The fixing device according to claim 1, wherein the cover member has an end part at a side near the center in the axial direction of the fixing belt and the end part is positioned at a position roughly coinciding with a boundary line between the passing area and the non-passing area.

4. The fixing device according to claim 1, wherein the nip part has a maximum passing area as an area where the recording medium with a maximum width passes through and a minimum non-passing area as an area outside the maximum passing area in an axial direction, the cover member has an end part at a side near the center in the axial direction of the fixing belt and the end part is positioned at a position roughly coinciding with a boundary line between the maximum passing area and the minimum non-passing area.

5. The fixing device according to claim 1 further comprising:

a temperature detecting part arranged at an outer circumference side of an end side in the axial direction of the fixing belt and configured so as to detect temperature of the fixing belt, wherein the cover member covers a part in the heat source body facing to the temperature detecting part in a radial direction.

6. The fixing device according to claim 1, wherein the plurality of through holes are formed in a slit-like shape extending in the axial direction of the fixing belt.

7. An image forming apparatus comprising:

a fixing device fixing an image on a recording medium, the fixing device includes:

an endless fixing belt rotatably arranged around a first rotation axis;

a pressuring member rotatably arranged around a second rotation axis in parallel to the first rotation axis and configured so as to form a nip part pressuring and making the recording medium pass through with the fixing belt;

a heat source body arranged inside the fixing belt and configured so as to have a longitudinal shape extending in roughly parallel to the first rotation axis and to heat the fixing belt by emitting radiant heat; and a cover member arranged between the fixing belt and the heat source body and configured so as to cover the heat source body, wherein the nip part has a passing area as an area where the recording medium passes through and a non-passing area as an area outside the passing area in an axial direction, the cover member covers a part of the heat source body corresponding to the non-passing area, the cover member includes a plurality of through holes formed so as to adjust surface temperature of the heat source body, the cover member is further composed of an upper plate part at an upper side and lateral plate parts at its both sides and the plurality of through holes are formed in the upper plate part.

8. The image forming apparatus according to claim 7, wherein the cover member is configured so that the size and the number of the through holes are determined so as to maintain the surface temperature of the heat source body by a surface limit temperature of the heat source body or less in a fixing operation.

9. The image forming apparatus according to claim 7, wherein the cover member has an end part at a side near the center in the axial direction of the fixing belt and the end part is positioned at a position roughly coinciding with a boundary line between the passing area and the non-passing area.

10. The image forming apparatus according to claim 7, wherein the nip part has a maximum passing area as an area where the recording medium with a maximum width passes through and a minimum non-passing area as an area outside the maximum passing area in an axial direction, the cover member has an end part at a side near the center in the axial direction of the fixing belt and the end part is positioned at a position roughly coinciding with a boundary line between the maximum passing area and the minimum non-passing area.

11. The image forming apparatus according to claim 7, wherein the fixing device further includes a temperature detecting part arranged at an outer circumference side of an end side in the axial direction of the fixing belt and configured so as to detect temperature of the fixing belt, the cover member covers a part in the heat source body facing to the temperature detecting part in a radial direction.

12. The image forming apparatus according to claim 7, wherein the plurality of through holes are formed in a slit-like shape extending in the axial direction of the fixing belt.

* * * * *